US006460701B1

(12) United States Patent
Nytko

(10) Patent No.: US 6,460,701 B1
(45) **Date of Patent: *Oct. 8, 2002**

(54) SPRAY NOZZLE MERCHANDISING PACKAGE

(75) Inventor: Robert Nytko, Washington, IL (US)

(73) Assignee: L. R. Nelson, Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/648,517

(22) Filed: Aug. 25, 2000

(51) Int. Cl.[7] ..... A45C 11/26; B65D 85/20
(52) U.S. Cl. ..... 206/349; 206/446
(58) Field of Search ..... 206/443, 446, 206/349, 327; 229/93; 312/45, 72

(56) References Cited

U.S. PATENT DOCUMENTS

| | | | | | |
|---|---|---|---|---|---|
| 2,415,589 | A | * | 2/1947 | Hahn | 206/327 |
| 2,665,826 | A | | 1/1954 | Mahoney | |
| 2,945,585 | A | * | 7/1960 | Whelan et al. | 206/327 |
| 3,012,698 | A | | 12/1961 | Wiederquist et al. | |
| 4,312,479 | A | * | 1/1982 | Tolan | 239/86 |
| 5,186,900 | A | * | 2/1993 | Jensen et al. | 229/93 |
| 5,400,928 | A | * | 3/1995 | Resnick | 206/446 |
| 5,700,075 | A | * | 12/1997 | Perone | 312/45 |
| 5,855,422 | A | * | 1/1999 | Naef | 312/45 |
| D446,116 | S | * | 8/2001 | Nytko | D9/428 |

FOREIGN PATENT DOCUMENTS

GB 2 219 520 A 12/1989

* cited by examiner

*Primary Examiner*—Bryon P. Gehman
(74) *Attorney, Agent, or Firm*—Mayer, Brown, Rowe & Maw

(57) ABSTRACT

A container device useful for selling nozzle heads for an irrigation system having various vertical sprinklers is disclosed. The container device has a tubular cylinder with an attachment end, an opposite open end and an exterior surface. The tubular cylinder is made of plastic and the attachment end is attached to a nozzle head. The nozzle head has a cylindrical base which mates with the attachment end of the tubular cylinder via a contact fit or screw-in threads. A debris screen for use with the nozzle head is fit within the tubular cylinder. The combination tubular cylinder and nozzle head allows inexpensive and simple packaging for the nozzle heads. The container device may be put on retail display with a gravity feed dispenser allowing dispensing of single containers for a consumer.

16 Claims, 3 Drawing Sheets

SPRAY NOZZLE MERCHANDISING PACKAGE

FIELD OF INVENTION

This invention relates to a packaging container for a spray nozzle. More specifically, this invention relates to a tubular package for merchandising and holding a spray nozzle for an irrigation sprinkler.

BACKGROUND OF INVENTION

A common irrigation system uses a network of pipes connected to sprinklers which are installed on vertical pipes which are dispersed to irrigate a certain area. The sprinklers are installed on vertical pipes and are capped by a nozzle head which allows water to be forced out of the nozzle head, under pressure, in various spray patterns. The nozzle heads determine the spray pattern. The nozzle heads are typically plastic and thus are designed to be easily removed from the remainder of the sprinkler. The nozzle heads also include a filter which prevents large pieces of debris from entering the sprinkler from entering the vertical pipe. The nozzle heads and filters wear out due to extreme temperatures or normal use quicker than the pipes or sprinklers. Thus a sprinkler user periodically replaces nozzle heads and the filters on various sprinklers in an irrigation system.

Such nozzle heads are presently packaged in a clam shell of clear plastic mounted to a rigid piece of backing cardboard. A vendor will hang the cardboard backing from a display rack for sale to a consumer. Such packaging is expensive resulting in more than one nozzle and filter set being packaged for one clam shell container to assist in defraying the costs of the clam and the cardboard backing. This forces a consumer to pay more for the item because they must buy more than one nozzle head at a time. The clam shell package is also bulky which results in fewer units being available for a vendor to be stored on a rack, a tray or a shelf.

One solution which has been proposed is to package a single nozzle and screen held together by a mechanical fastener. Such a fastener is typically threaded on the nozzle to attach the screen. The packaged item is then presented to the consumer in bulk with a protruding tag to identify the product and offer a location for UPC code. However, this configuration exposes the screen to dirt, debris or accidental contact while on display at a store. Additionally, the tag readily tears off. Finally, the product may only be offered in bulk packages in this configuration because the package cannot be stacked or compactly stored.

Thus, there exists a need for a compact and inexpensive packing apparatus for nozzle head and debris screen sets. There also exists a need for a package which allows the economic sale of single spray nozzle heads. There is a further need for a package which is compact to take less space in at a store or display area.

SUMMARY OF THE INVENTION

The present invention is embodied in a merchandising container for use with a nozzle head attachable to a sprinkler. The nozzle head has a cylindrical base and the container has a tubular cylinder with an exterior surface and an attachment end which is mateable with the cylindrical base of the nozzle head.

The present invention is also embodied in a container for selling nozzle heads for sprinkler irrigation systems. The container has a tubular cylinder with exterior surface and an attachment end. A nozzle head has a cylindrical base member which is mateable with the attachment end of the tubular cylinder.

The present invention is also embodied in a dispensing apparatus for holding nozzle heads for irrigation systems. The dispensing apparatus has a substantially vertical guide having an interior surface profile, a top opening and a bottom opening. A catch tray is coupled to the bottom opening. A plurality of container units are stored in the substantially vertical guide. The container units all have volume sufficient to be stacked on each other and capable of being placed in the guide via the top opening. The container units are forced via gravity out of the bottom opening such that one of the plurality of container units are caught by the catch tray. The container in the tray blocks the remainder of the container units from exiting from the bottom opening. Each of the container units has a tubular cylinder with an exterior surface and an attachment end. A nozzle head having a cylindrical base member is mateable with the attachment end of the tubular cylinder.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DESCRIPTION OF THE PREFERRED EMBODIMENT

Figure 1:
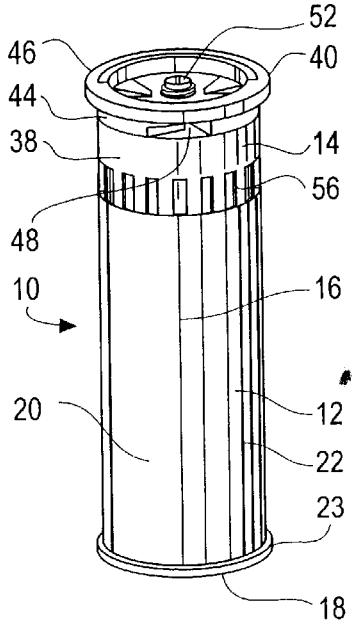
FIG. 1 is a perspective view of a spray nozzle head merchandising container according to embodiment of the present invention.
Figure 2:
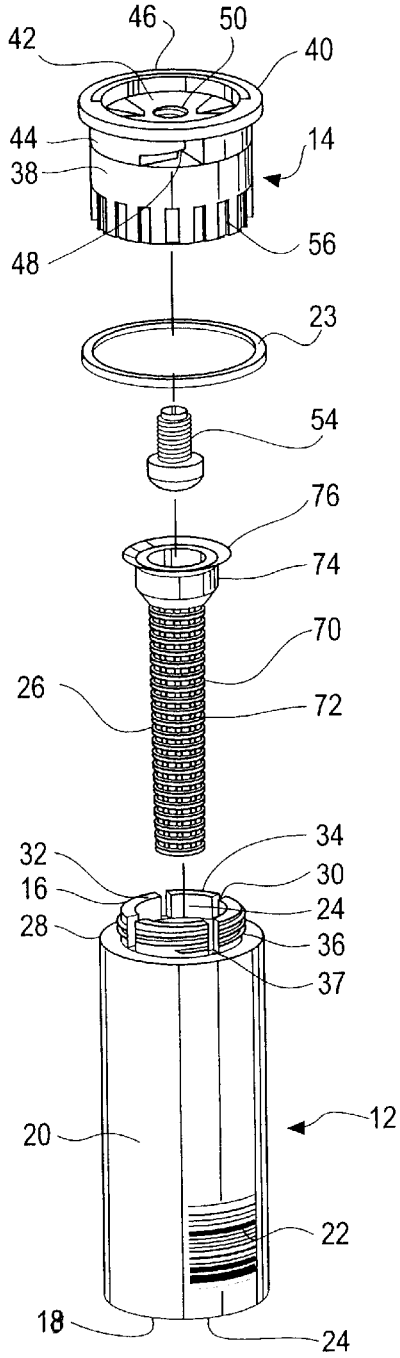
FIG. 2 is a exploded view of the spray nozzle head merchandising container and the spray nozzle of FIG. 1 according to one embodiment of the present invention.
Figure 3:
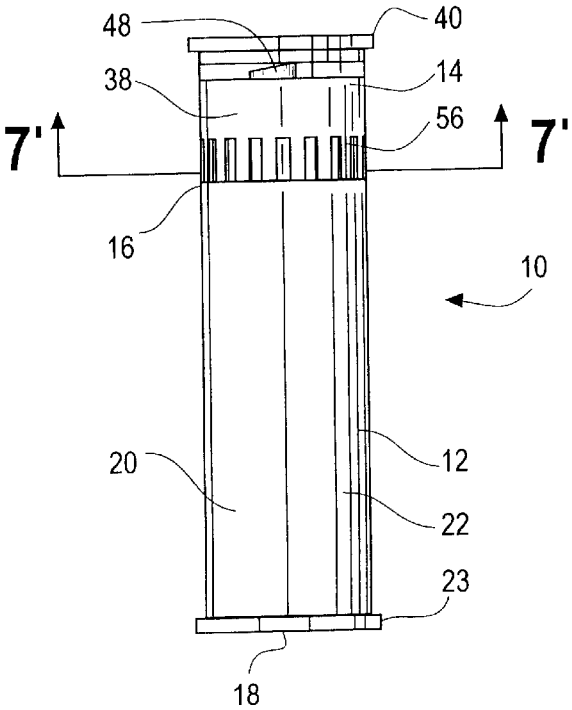
FIG. 3 is a front view of the spray nozzle head merchandising container of FIG. 1.
Figure 4:
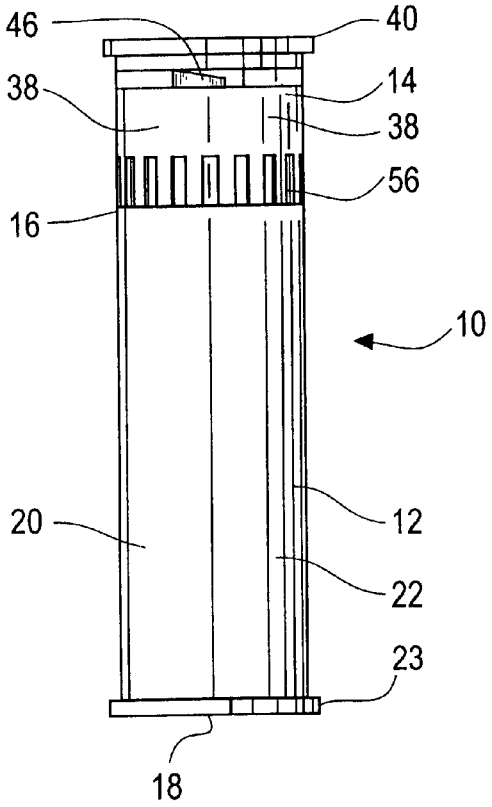
FIG. 4 is a back view of the spray nozzle head merchandising container of FIG. 1.
Figure 5:
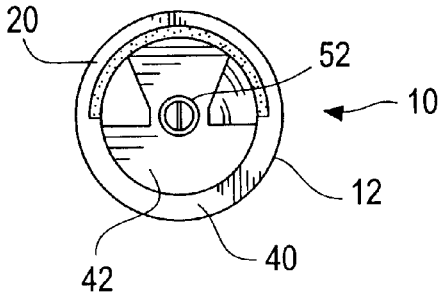
FIG. 5 is a top view of the spray nozzle head merchandising container of FIG. 1.
Figure 6:
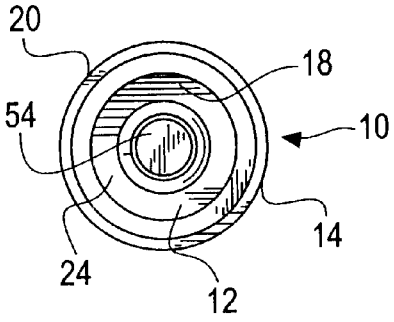
FIG. 6 is a bottom view of the spray nozzle head merchandising container of FIG. 1

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Referring now more particularly to FIGS. 1–6 of the drawings, there is shown therein a spray nozzle head merchandising unit generally indicated at 10, which is an embodiment of the present invention. As shown, the spray nozzle head merchandising unit 10 has a cylindrical tube 12 and a spray nozzle head 14. The cylindrical tube 12 has an attachment end 16 and an opposite open end 18. The cylindrical tube 12 is a single molded piece which is preferably plastic, but other materials such metal or cardboard may be used. The cylindrical tube 12 has sufficient diameter to accommodate the spray nozzle 14. The cylindrical tube 12 has an exterior surface 20 which has a product label 22. The product label 22 may be used for a UPC code or other forms of identification of the product. The exterior surface 20 may also be used for additional information such as packaging insignia, instructions or other graphical information. The cylinder 12 has a ring 23 attached on the opposite end 18. The ring 23 has the same diameter as top of the nozzle head 14 to facilitate storage, thus requiring fewer materials to form the cylinder 12. Alternatively, the entire diameter of the cylinder 12 may be the same as that of the nozzle head 14.

The cylindrical tube 12 has an interior cavity 24. A debris screen 26 is placed in the interior cavity 24 and is sold in conjunction with the nozzle head 14. The cylindrical tube 12 protects the debris screen 26 from inadvertent contact and particles when on display The attachment end 16 has an annular shoulder 28. An annular coupler 30 is located on the annular shoulder 28 and has a top lip 32 which has a circular opening 34. The exterior surface of the annular coupler 30 has a series of threads 36 for holding the nozzle head 14. The annular coupler 30 has a series of notches 37 which are interspaced circumferentially.

The nozzle head 14 has a main body portion 38 which is generally cylindrical in shape and of roughly the same diameter of the cylindrical tube 12. The top of the main body portion 38 has an annular collar 40 which forms a closed lid 42. An annular notch 44 is formed under the annular collar 40. The annular notch 44 has two slots 46 and 48 which allow water flow from the nozzle head 14 when installed on a sprinkler. Of course different numbers and shaped slots may be used to vary the pattern of water flow.

The top surface of the closed lid 42 has a center hole 50 which allows the insertion of a nut 52 which is mated with a screw 54 to hold the main body portion 38 to the closed lid 42. The exterior of the main body portion 38 has a series of ridges 56 which assist in the attachment of the nozzle head 14 to a sprinkler body.

Figure 7:
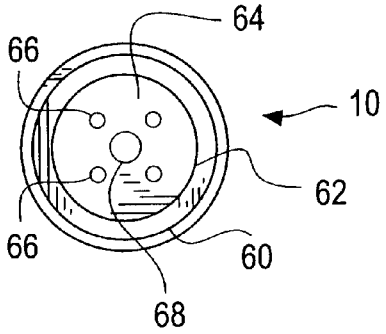
FIG. 7 is a cutaway view of the spray nozzle head taken along line 7–7' in FIG. 3.

The bottom of the body 38 forms an interior compartment 58 which has an interior surface 60 as shown in FIG. 7. The interior surface 60 has a series of threads 62 which are mateable with the threads 36 on the annular coupler 30 or the threads on the sprinkler body (not shown). The interior compartment 60 is bounded by a retaining wall 64 which has a series of water holes 66 and a center hole 68 which accommodates the screw 54.

The debris filter 26 has a tubular stem 70 which has a mesh surface 72 allowing water to enter into the tubular stem 70. The mesh surface 72 serves to trap debris from the water flow. The tubular stem 70 is attached to the bottom of a cylinder 74. The top of the cylinder 74 is open ended with a rim 76. The tubular stem 70 is insertable through the circular opening 34 of the tubular cylinder 12. The rim 76 is of a sufficient diameter to rest on the top lip 32 of the annular collar 30 of the tubular cylinder 12. In this manner the tubular stem 70 is suspended in the interior cavity 24 of the tubular cylinder 12.

The nozzle head 14 is attached to the tubular cylinder 12 by screwing on the main body portion 38 via the interior threads 62 to the threads 36 of the annular collar 30. In this manner, the debris filter 26 is locked in place by the placement of the rim 76 between the rim 32 of the cylinder 12 and the wall 64 of the nozzle head 14. Of course other mechanisms may be used to connect the tubular cylinder 12 with the nozzle head 14 such as by using a press fit between the annular collar 30 of the cylinder 12 and the interior surface 60 of the nozzle head 14. Alternatively, the nozzle head 14 could provide the male threading while a female socket could be provided on the interior cavity 24 of the tubular cylinder 12.

Figure 8:
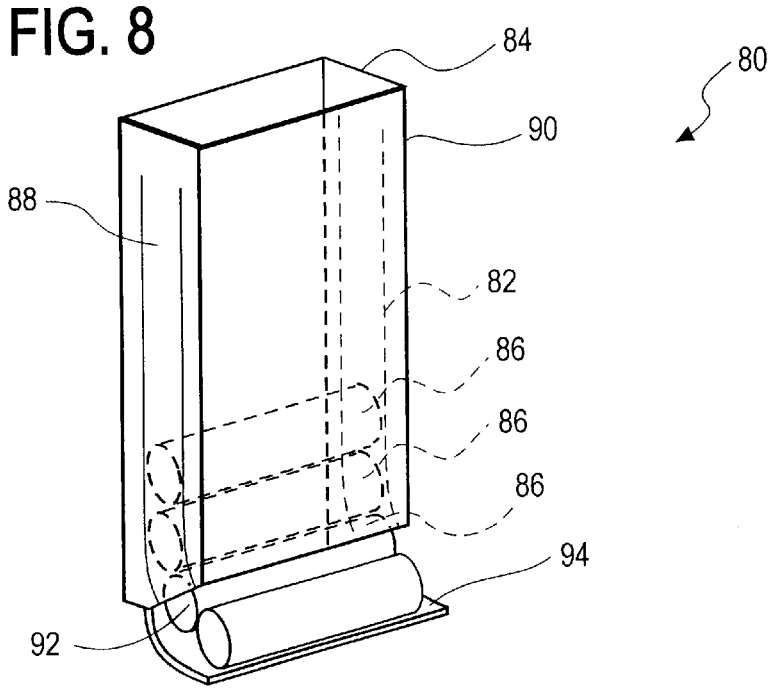
FIG. 8 is a perspective view of a dispenser for the spray nozzle merchandiser of FIG. 1.

The packaging unit 10 provides a simple means to package a single nozzle head and debris screen. The packaging unit 10 allows ease of manufacturing as it permits automated assembly of the nozzle head 14 to the tubular cylinder 12. The slots 37 on the annular collar 30 provide for the automated assembly by allowing the annular collar 30 to flex thereby allowing the nozzle head 14 to be pushed onto the tubular cylinder 12 in the assembly process. The packaging unit 10 may be easily placed in a variety of storage and display areas such as baskets and buckets or stood upright on shelving. The packaging unit 10 may also be placed in a gravity feed dispenser 80 as shown in FIG. 8. The gravity feed dispenser 80 has a chute 82 which has a top opening 84. A series of packaging units 86 may be top loaded from the top opening 84. The chute 82 has a pair of guide slots 88 and 90 which guide the packaging units 86. The cross section of the chute 82 is approximately the same as that of the packaging units 86 such that the packaging units 86 are stacked on each other. A bottom feed slot 92 allows the packaging units 86 to be dispensed. A tray 94 holds a packaging unit which is available to a consumer. Once the packaging unit on the tray 94 is removed, gravity forces the rest of the packaging units 86 down the chute 82 thus depositing the next packaging unit in the tray 94. The gravity feed dispenser 80 is compact but allows display of the packaging units while allowing a consumer to take as many nozzle heads as they desire. Alternatively, a wire frame or other interior guides may be used to retain the packaging units 86.

Figure 9:
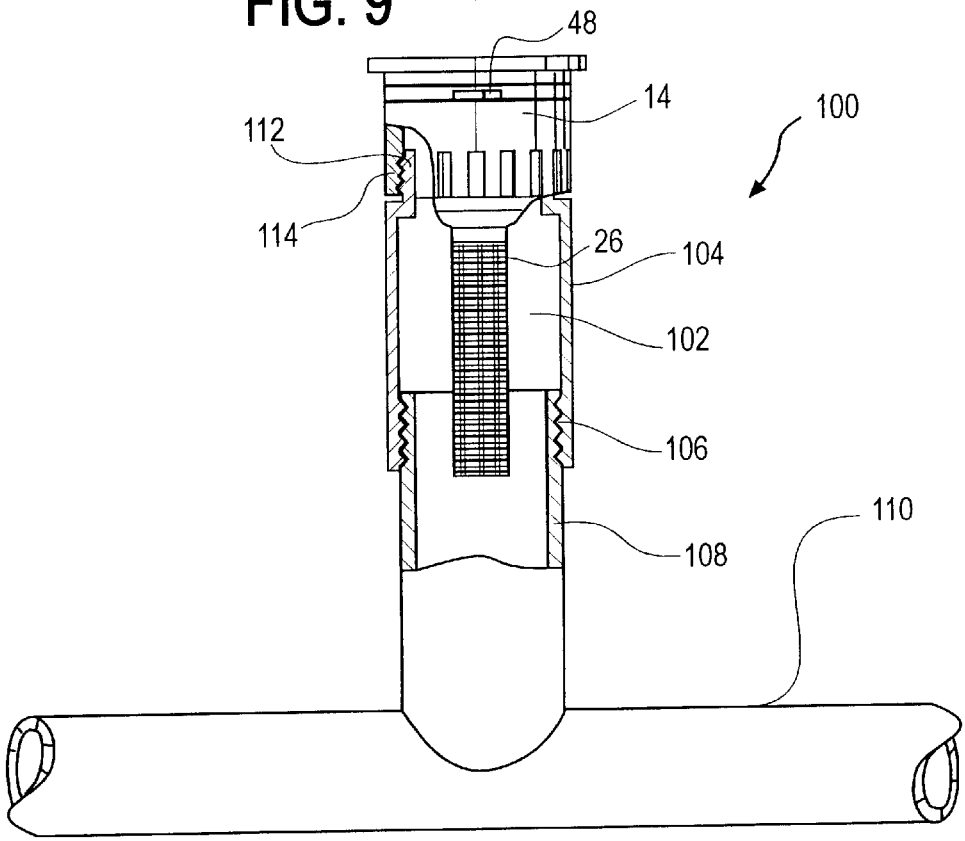
FIG. 9 is a perspective view of the nozzle head separated from the merchandising container of FIG. 1 and attached to a sprinkler unit.

Once a consumer purchases the packaging unit 10, they remove the nozzle head 14 and the debris screen 26 from the cylinder 12. The nozzle head 14 and the debris screen 26 are installed on a sprinkler unit and the cylinder 12 is discarded. FIG. 9 shows a sprinkler head unit 100 with the nozzle head 14 and debris screen 26 installed. The sprinkler head unit 100 has a water passage 102 which is formed by an upright tube 104. The tube 104 is coupled via a coupler 106 to a vertical pipe 108. Water flows through the vertical pipe 108 from an underground pipe network 110.

The sprinkler head unit 100 has an annular collar 112 with exterior threads 114. The nozzle head 14 is thus screwed onto the exterior threads 114 to create a water tight seal. Pressurized water which is supplied by the water passage 102 is forced out of the slots 48.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A merchandising container for use with a nozzle head attachable to a sprinkler, the nozzle head having a cylindrical base, the container comprising a tubular cylinder with an exterior surface and an attachment end which is mateable with the cylindrical base of the nozzle head wherein the attachment end of the tubular cylinder includes an annular collar having exterior threads;

wherein an interior surface of the cylindrical base of the nozzle head has interior threads and is mateable with the tubular cylinder via the interlocking of the threads; and wherein the annular collar has at least one slot, allowing the collar to flex, on attachment to the nozzle head.

2. The merchandising container of claim 1 wherein the exterior surface of the tubular cylinder has a label space.

3. The merchandising container of claim 1 wherein the attachment end of the tubular cylinder includes an annular collar which is mateable with the nozzle head via a contact fitting between the annular collar and an interior surface of the cylindrical base of the nozzle head.

4. The merchandising container of claim 1 wherein the tubular cylinder is plastic.

5. A container for selling nozzle heads for sprinkler irrigation systems, the container comprising:

a tubular cylinder having a uniform diameter with an exterior surface and an open attachment end; and a nozzle head having a cylindrical base member with an exterior surface which is mateable with the attachment end of the tubular cylinder and has a diameter approximately the same as that of the tubular cylinder such that the exterior surfaces of the tubular cylinder and the cylindrical base member form a continuous surface when the nozzle head is mated with the tubular cylinder.

6. The container of claim 5 further comprising a debris filter fitted within the tubular cylinder.

7. The container of claim 5 wherein the exterior surface of the tubular cylinder has a label space.

8. The container of claim 5 wherein the attachment end of the tubular cylinder includes an annular collar which is mateable with the nozzle head via a contact fitting between the annular collar and the interior surface of the cylindrical base member of the nozzle head.

9. The merchandising container of claim 5 wherein the attachment end of the tubular cylinder includes an annular collar having exterior threads, and wherein an interior surface of the cylindrical base member of the nozzle head has interior threads and is mateable with the tubular cylinder via the interlocking of the threads.

10. The container of claim 5 wherein the tubular cylinder is plastic.

11. A dispensing apparatus for holding nozzle heads for irrigation systems, the dispensing apparatus comprising: a substantially vertical chute having an interior surface profile, a top opening and a bottom opening;

a catch tray coupled to the bottom opening;

a plurality of container units stored in the substantially vertical chute, the chute having a cross-section allowing the container units to be stacked on each other and the container units placeable in the guide via the top opening and being forced via gravity out of the bottom opening such that one of the plurality of container units are caught by the catch tray and block the remainder of the container units from exiting from the bottom opening, each of the container units having:

a tubular cylinder with an exterior surface and an attachment end; and a nozzle head having a cylindrical base member which is mateable with the attachment end of the tubular cylinder a tubular cylinder having a uniform diameter with an exterior surface and an open attachment end; and a nozzle head having a cylindrical base member with an exterior surface which is mateable with the attachment end of the tubular cylinder and has a diameter approximately the same as that of the tubular cylinder such that the exterior surfaces of the tubular cylinder and the cylindrical base member form a continuous surface when the nozzle head is mated with the tubular cylinder.

12. The dispensing apparatus of claim 11 wherein the container units further include a debris filter fitted within the tubular cylinder.

13. The dispensing apparatus of claim 11 wherein the exterior surface of the tubular cylinder has a label space.

14. The dispensing apparatus of claim 11 wherein the attachment end of the cylindrical tube includes an annular collar which is mateable with the nozzle head via a contact fitting between the annular collar and an interior surface of the cylindrical base member of the nozzle head.

15. The dispensing apparatus of claim 11 wherein the attachment end of the cylindrical tube includes an annular collar having exterior threads, and wherein the interior surface of the cylindrical base member of the nozzle head has interior threads and is mateable with the tubular cylinder via the interlocking of the threads.

16. The dispensing apparatus of claim 11 wherein the tubular cylinder is plastic.

* * * * *